US005157805A

United States Patent [19]

Pinter

[11] Patent Number: 5,157,805

[45] Date of Patent: Oct. 27, 1992

[54] METHOD AND APPARATUS FOR CLEANING CARPET OR THE LIKE

[76] Inventor: Henry J. Pinter, 130 W. Vine St., Alliance, Ohio 44601

[21] Appl. No.: 684,764

[22] Filed: Apr. 15, 1991

[51] Int. Cl.[5] ..... A47L 9/02

[52] U.S. Cl. ..... 15/322; 15/321

[58] Field of Search ..... 15/321, 322

[56] References Cited

U.S. PATENT DOCUMENTS

| | | | |
|---|---|---|---|
| 4,127,913 | 12/1978 | Monson | 15/321 |
| 4,137,600 | 2/1979 | Albishausen | 15/322 |
| 4,282,626 | 8/1981 | Schneider | 15/320 |
| 4,334,336 | 6/1982 | Harbeck et al. | 15/322 |
| 4,335,486 | 6/1982 | Kochte | 15/321 |
| 4,360,946 | 11/1982 | Marshall, Jr. et al. | 15/321 |
| 4,488,330 | 12/1984 | Grave | 15/322 |
| 4,521,935 | 6/1985 | Johnston et al. | 15/322 |
| 4,584,736 | 4/1986 | Gremminger | 15/322 |
| 4,597,124 | 7/1986 | Williams et al. | 15/322 X |
| 4,649,594 | 3/1987 | Grave | 15/322 |

FOREIGN PATENT DOCUMENTS 350746 1/1990 European Pat. Off. ..... 15/322

*Primary Examiner*—Chris K. Moore
*Attorney, Agent, or Firm*—Reese Taylor

[57] ABSTRACT

Apparatus for and method of cleaning carpet or the like in conjunction with a vacuum source and a source of pressurized cleaning fluid. The apparatus includes an elongate handle to which is attached a cleaning head. The cleaning head includes a forward wall and a striker plate disposed in generally parallel relationship to form a vacuum chamber. A nozzle assembly for dispensing the pressurized fluid is carried by the cleaning head so as to direct the fluid against the striker plate at a point above the carpet surface. Alternative embodiments include the addition of one or more brushes disposed in front of the striker plate. The method includes so directing the fluid so that it is drawn around the edge of the striker plate, through the pile of the carpet and into the vacuum chamber as the apparatus is moved across the carpet.

18 Claims, 4 Drawing Sheets

METHOD AND APPARATUS FOR CLEANING CARPET OR THE LIKE

BACKGROUND OF THE INVENTION

This invention relates in general to a method and apparatus for cleaning carpets or similar fabrics using high pressure wet vacuum cleaners and relates in particular to an improved method and apparatus for cleaning such material without unduly saturating the pad or base portion of the carpet while still thoroughly cleaning the pile portion.

DESCRIPTION OF THE PRIOR ART

Wet vacuum cleaners for carpets or rugs or, for that matter, other material of that general nature, such as upholstery or drapes, are well-known in the art and generally are used to accomplish a more thorough cleaning than dry vacuum cleaners. These cleaners generally comprise apparatus for continuously applying a cleaning fluid solution, such as water or water mixed with other cleaning agents such as, for example, detergents, to the fabric to be cleaned and then vacuuming the fluid back up from the material.

To that end, they generally include a handle or wand which is connected to both a source of pressurized cleaning fluid and a vacuum source. The handle generally has a material engaging end which is passed over the material to be cleaned and which may or may not include one or more brushes. A dispensing nozzle is carried by the handle or the material engaging end and is disposed adjacent the material engaging end so as to dispense the cleaning fluid solution onto the material to be cleaned.

The usual method of operation is to direct a high pressure stream of cleaning solution into the carpet as the cleaner is passed along the surface while simultaneously suctioning the cleaning solution and debris with the vacuum.

There are a number of patents disclosing various apparatus which will accomplish, in general terms, the above-noted function.

For example, Grave U.S. Pat. No. 4,488,330 shows apparatus for directing the cleaning fluid mixture from a nozzle at an angle into the carpet so as to strike just below the vacuum port wall and then vacuuming the material back up through a vacuum chamber to an extraction tank. Grave U.S. Pat. No. 4,649,594 discloses a similar arrangement.

Schneider U.S. Pat. No. 4,282,626 discloses an apparatus in which the cleaning fluid flow is directed against an inclined rear wall of the cleaning chamber and then onto the carpet, following which the fluid and dirt are extracted by the vacuum.

Other examples of such apparatus can be seen in Monson U.S. Pat. No. 4,127,913; Harbeck U.S. Pat. No. 4,334,336; Kochte U.S. Pat. No. 4,335,486; Marshall U.S. Pat. No. 4,360,946; and Johnston U.S. Pat. No. 4,521,935.

Many of the patents just discussed recognize the problem to which the current invention is directed.

Specifically, in using high pressure cleaners of this general type, there is a serious difficulty with over-saturation of the carpet. In that regard, the carpet is generally comprised of a pile or weft and an underlying pad or base with the fibers making up the pile or weft being glued or otherwise affixed to the pad or base which is, in turn, glued or otherwise secured to the supporting floor surface.

The difficulty is that there is a tendency for the cleaning fluid mixture, which is applied under relatively high pressure, to penetrate down into the pad, and it has generally been found that it is not possible, once this happens, to fully extract the fluid along with the dirt which will have been separated from the carpet. The result is that, no matter how much vacuum force is utilized, after an operation like this, the carpet is either never thoroughly dried or dries too slowly.

This leads to a number of negative results. For one thing, the soggy base or pad tends to deteriorate and also, being saturated, is a collecting point for germs. This latter phenomenon is particularly objectionable in view of current concerns over environmental contamination. For another thing, there is a tendency, due to the continuing wetness of the pad or base for, in some instances, the weft or pile to actually separate over a period of time. Also, the usual arrangement causes the pressurized cleaning solution itself to actually drive the dirt into the base, making it more difficult to remove.

Accordingly, while wet vacuum cleaners are very desirable in the carpet cleaning industry and provide improved cleaning properties as contrasted to dry vacuums, they definitely present some difficulties.

As previously noted, some of the prior art patents referred to herein have recognized this problem. For example, the Graves patents disclose directing the fluid at a shallow angle with respect to the carpet surface to avoid the deep penetration of the fluid. The Kochte patent discloses the use of a drip felt through which the cleaning fluid passes so as to apply only a head of cleaning fluid and thereby avoid over penetration into the carpet structure.

While these structures may well be operative, it is believed that there are still difficulties present when the pressurized fluid is applied directly to the carpet as in Graves or only deposited thereon by seeping through a member such as felt as in Kochte.

In the one instance, due to the force of the fluid stream, the danger of over saturation still exists and, in the other instance, the fluid is applied at a point too remote from the vacuum source to avoid deep penetration.

Applicant has found that, by providing a unique combination of spray and vacuum apparatus and insuring that the spray does not penetrate too deeply, the above-noted deficiencies can be avoided.

SUMMARY OF THE INVENTION

It accordingly becomes a principal object of the present invention to provide a carpet cleaner wherein cleaning fluid under pressure can be applied to the pile only and efficiently removed therefrom.

It has been found that, by providing a spray vacuum apparatus having a housing with parallel walls spaced from each other so as to form a vacuum chamber, a striker plate carried by the rearmost wall and by providing a nozzle wherein the spray is directed against the striker plate itself, the capillary action of the water moving down the back of the striker plate and around its projecting edge and back up to the vacuum chamber will insure that the cleaning fluid penetrates only the pile or nap of the carpet and not on into the warp or base.

It has further been found that an adjustable nozzle can be provided so that the point at which the stream of cleaning fluid impacts the striker plate can be altered so that the apparatus may be used to effectively clean carpets having piles of different depths.

It has also been found that by uniquely configuring the interior wall of the vacuum chamber, more efficient use of the vacuum can be obtained, thus increasing the velocity of the solution about the edge of the striker plate through the carpet pile and into the vacuum chamber.

In a modified form of the invention, it has been found that brushes for facilitating loosening of the dirt can be incorporated into the basic apparatus between the striker plate and the rearmost wall so that the cleaning fluid solution can be directed against the striker plate, through the brushes and the carpet pile and into the vacuum chamber, again without over deep penetration into the carpet.

Accordingly, production of an improved apparatus for cleaning carpet of the type above-described becomes the principal object of this invention with other objects thereof becoming more apparent upon a reading of the following brief specification considered and interpreted in view of the accompanying drawings.

BRIEF DESCRIPTION OF THE DISCLOSED EMBODIMENTS

Before describing the apparatus and method of the present invention in detail, it should first be noted that the invention has utility in cleaning a variety of materials. Therefore, while the invention will be described in connection with cleaning carpets for simplicity of illustration and description, it will be understood that it is not intended to be so limited.

Figure 1:
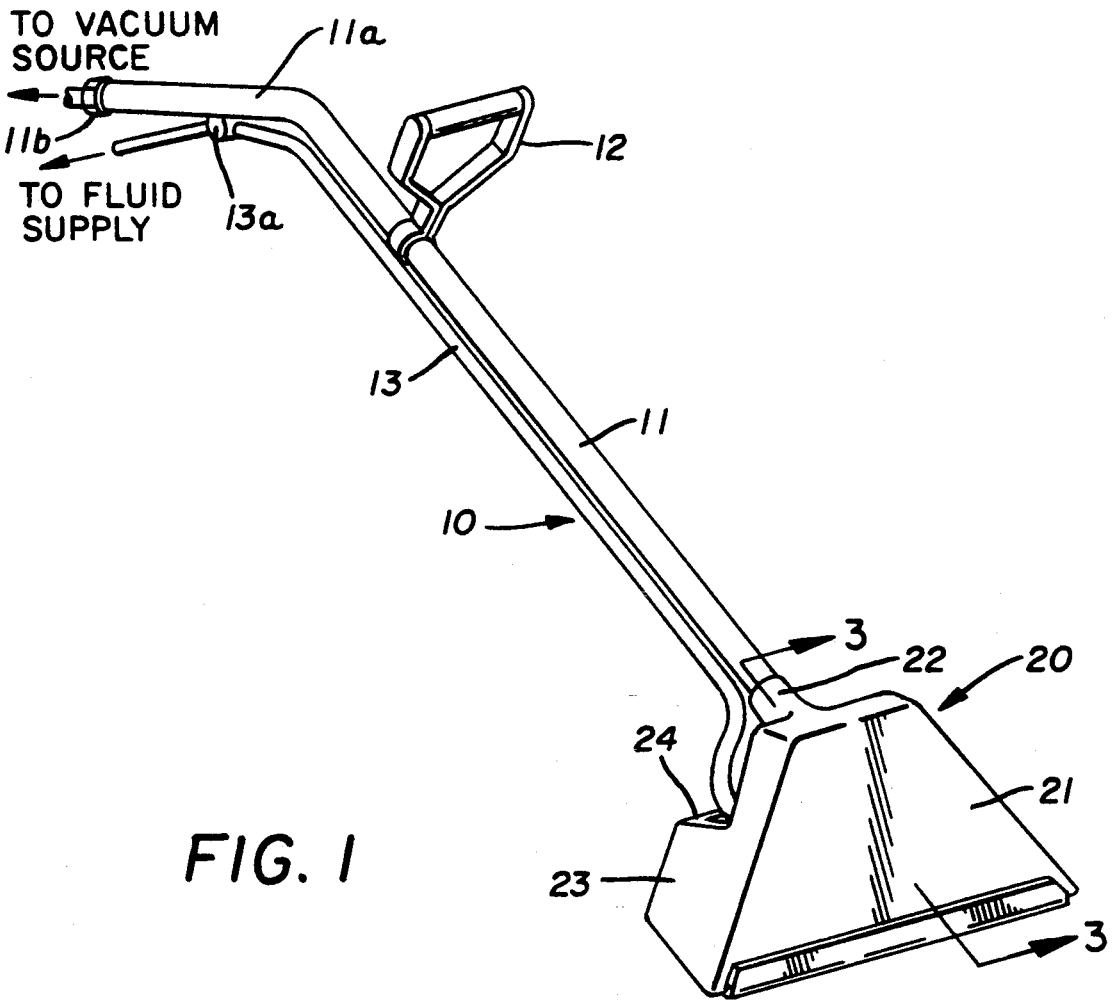
FIG. 1 is a perspective view of the improved carpet cleaning apparatus.

Referring first then to FIG. 1, it will be noted that the improved cleaning apparatus, generally indicated by the numeral 10, includes an elongate wand or handle 11 and a cleaning head 20.

The wand or handle 11 has a first end 11*a* contoured for easy gripping by the operator and a gripping handle 12 also for gripping by the operator. The wand or handle 11 is hollow and terminates at its upper end in a fitting 11*b* which leads to the vacuum source and ultimately to the extractor tank (not shown). As will be described below, the handle 11 thus forms part of the vacuum system for removal of the cleaning fluid and dirt.

Also secured to the wand or handle 11 is a fluid supply line 13 which, again, at its upper end, leads to a pressurized source of fluid cleaning supply. It will be readily understood that the valve 13*a* can be of any conventional construction and serves merely to control the fluid supply.

Figure 2:
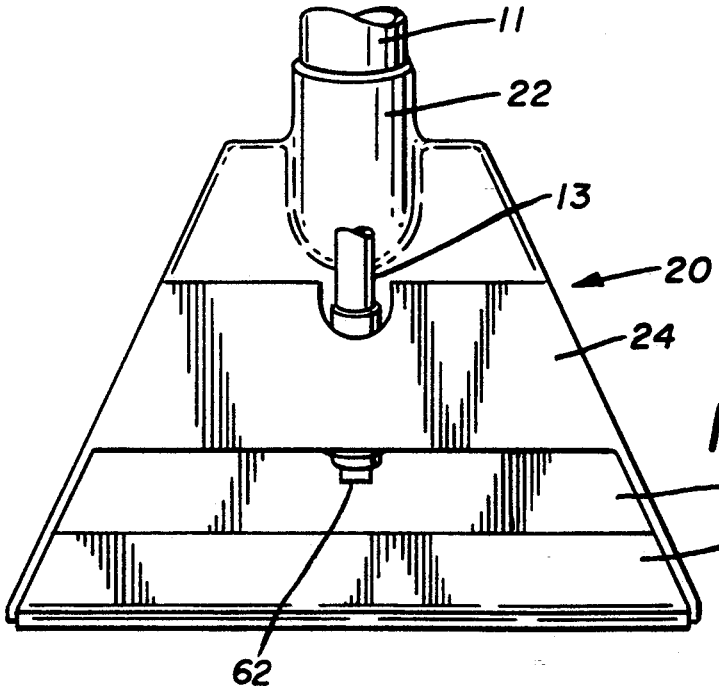
FIG. 2 is a rear elevational view of the cleaning head thereof.

Still referring to FIGS. 1 and 2 of the drawings, it will be seen that the cleaning head 20 is secured to the opposed end of handle 11 by any suitable means and consists of a substantially closed housing which has a forward wall 21 terminating in a projecting lower end 21*a* and an annular connecting neck 22 which is intended to be received on the end of the wand or handle 11. This housing also has opposed side walls 23,23 and a back wall 24 and may be formed from one piece of material or fabricated by welding or otherwise securing the just described components together.

As can be seen in FIGS. 1 through 4 of the drawings, a second or rearmost wall is also part of the cleaning head 20 and is disposed in generally parallel relationship with and spaced from the forward wall 21 thereof. This rearmost wall is generally indicated by the numeral 30 and has a rear surface 32 and a forward surface 33 as well as a projecting lower end 31. In this way, the rearmost wall 30 and forward wall 21 of the cleaning head 20 form a vacuum chamber 40 through which the cleaning fluid and dirt can be evacuated.

As illustrated in FIGS. 1 through 4 of the drawings, a striker and wear plate 50 is received on projecting lower end 31 of the rearmost wall 30 of the housing. A wear plate 51 is also received on the projecting lower end 21*a* of forward wall 24. These plates are intended to be removable and facilitate movement of the apparatus across the surface of the carpet being cleaned. Also, striker and wear plate 50 serves as the impact surface for the stream of cleaning fluid as will be described below. Both plates 50 and 51 may be simply press fit on the ends 21*a* and 31 or otherwise secured thereto.

Figure 3:
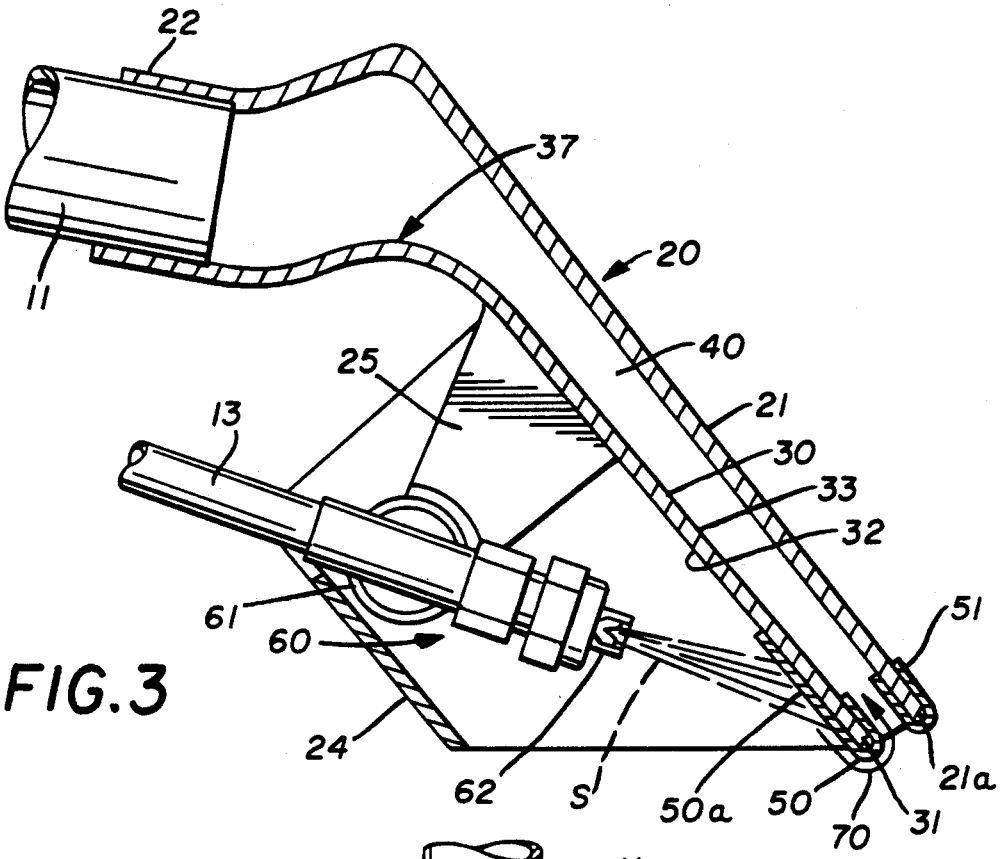
FIG. 3 is a sectional view taken along the line 3—3 of FIG. 1.
Figure 4:
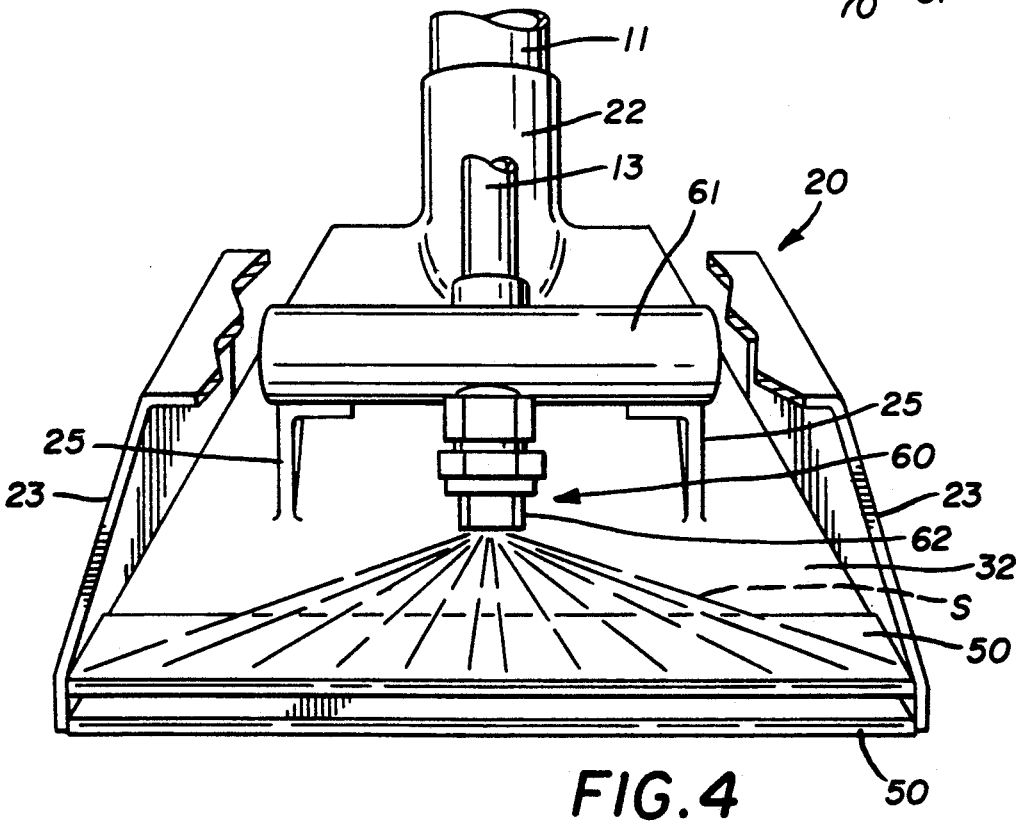
FIG. 4 is an enlarged rear view partially broken away.

Still referring to FIGS. 3 and 4 of the drawings, it will be seen that a dispensing assembly 60 is provided and, in the form of the invention illustrated in FIGS. 1 through 4 of the drawings, includes a tubular cross piece 61 which is pivotally mounted on parallel support arms 25,25 which are integral with and project from rearmost wall 30. This permits the dispensing assembly 60, along with nozzle 62, to be adjusted by rotating cross piece 61 so as to affect the location at which the spray S strikes the rear surface 32 of the rearmost wall 30 or, as illustrated in the drawings, strikes the rear surface 50*a* of the striker and wear plate 50 mounted thereon. Thus, while use of striker and wear plate 50 facilitates movement of the apparatus across the surface to be cleaned, it could be dispensed with if necessary.

In use or operation, it will be appreciated that, as the apparatus 10 is moved across the carpet, the cleaning fluid, which is propelled from the dispensing assembly 60 at considerable force, will strike either rearmost wall 30 or striker and wear plate 50 and flow down along rear wall 30 thereof and around either the radiused end 31 of rearmost wall 30 or the radiused end of wear plate 50. In combination with the force in the vacuum chamber 40 which assists the normal capillary action of the fluid, the fluid will be pulled around the end and back up through the chamber 40 as indicated by arrow 70. However, enough will exit beneath the lower edge to fully wet the pile or weft of the carpet, thereby dislodging dirt and debris without penetrating to the warp or base.

By maintaining constant vacuum in chamber 40, the cleaning solution will hug the radiused area of the wear plate 50 and will pass around it at a significant velocity for improved cleaning efficiency, but will be prevented from over penetration into the carpet.

It should also be noted here that the adjustment of dispensing assembly 60 enables carpets with deeper or shallower piles to be accommodated. Thus, for a deep pile, the fluid will be aimed so as to strike near the bottom of rearmost wall 30 or striker and wear plate 50 and may be moved up on the plate for shallower piles.

It should be noted here that the lowermost end 31 of wall 30 and the bottom of striker and wear plate 50 are radiused to facilitate movement of fluid about the end as well as to facilitate movement of the apparatus across the carpet. This last function could be enhanced by enlarging the radius.

Additionally, the efficiency of the vacuum operation is enhanced by the internal configuration of the cleaning head 20. Generally, in the known prior art, a sharp angle is formed at the point at which rearmost wall 30 tapers into the neck which engages the end of handle 11. The natural tendency then is for the vacuum to find the center of the tube. By providing a smooth radiused area at 37, the entire chamber 40 tends to become vacuumized. This increases the velocity of the fluid around the radiused end of wear plate 50, thus further enhancing the cleaning properties of the apparatus.

Figure 5:
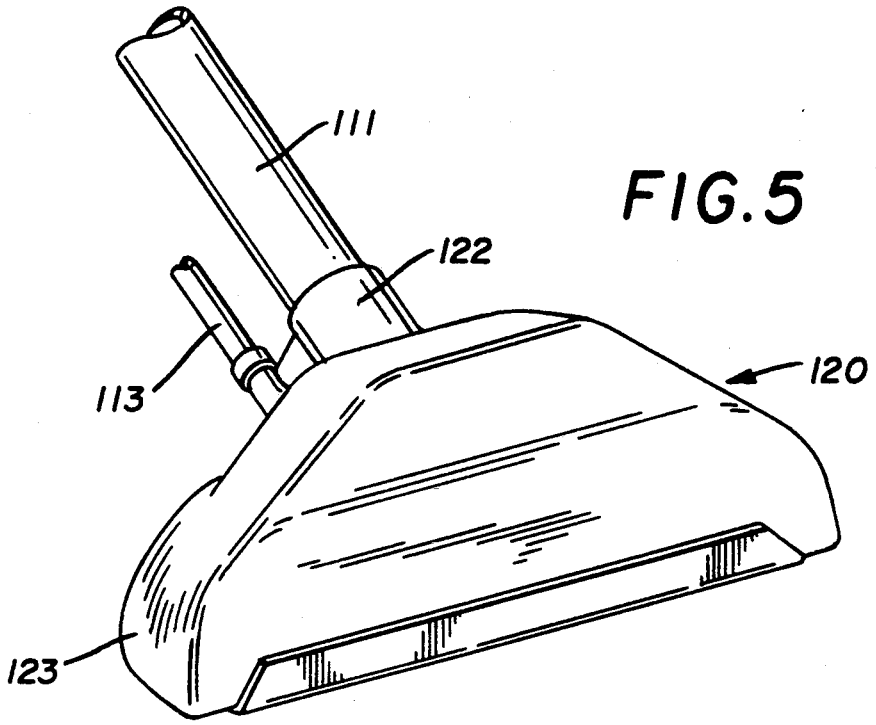
FIG. 5 is a partial perspective view of a modified form of the invention.
Figure 6:
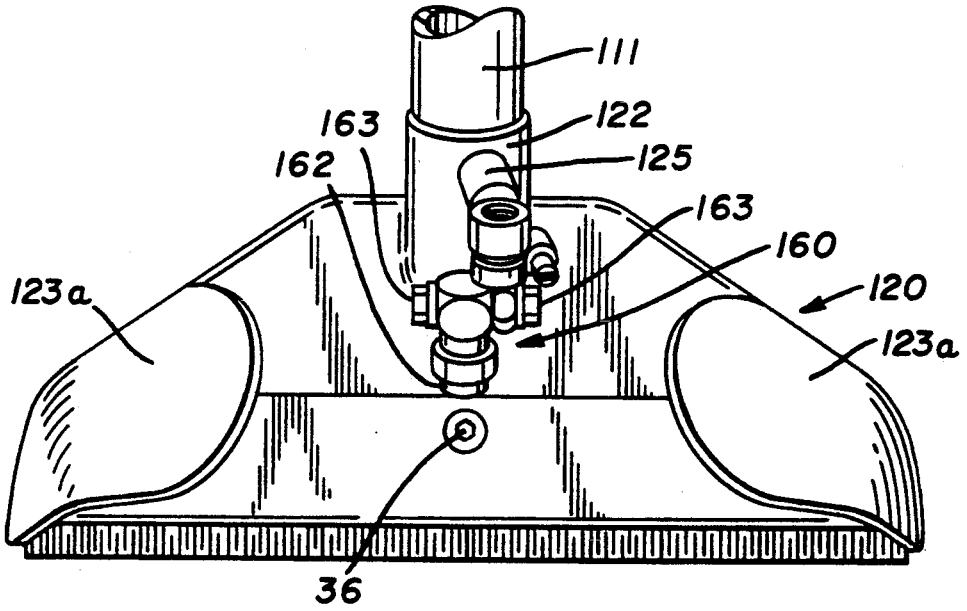
FIG. 6 is a rear view of the form of the invention illustrated in FIG. 5.
Figure 7:
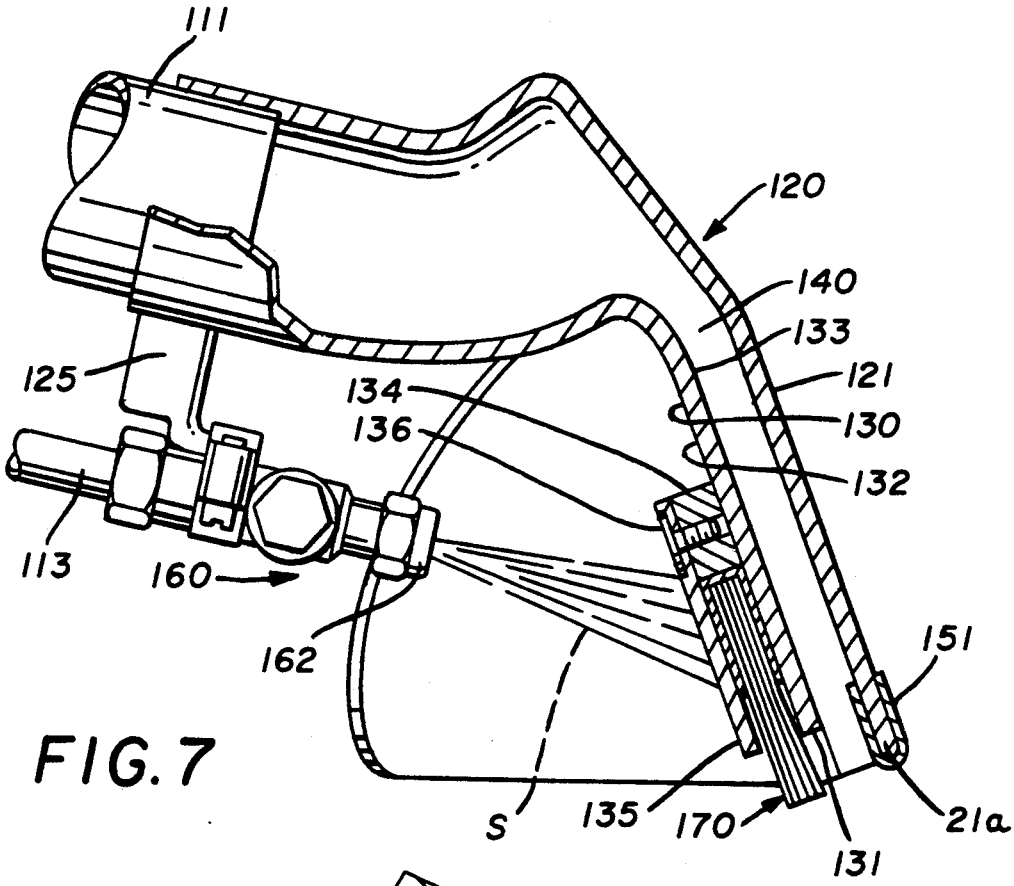
FIG. 7 is a sectional view taken along the line 7—7 of FIG. 5.

FIGS. 5 through 7 illustrate a modified form of the invention wherein similar numerals in the 100 series designate comparable structural members.

It will be seen that, essentially, the overall structure is quite similar, although the mounting means for the nozzle assembly 160 is slightly different, but still presents an adjustment capability. Thus, a single support arm 125 is provided and the dispensing assembly 160 and nozzle 162 may be adjusted by loosening nuts 163,163.

In this embodiment of the invention, however, a brush 170 is employed to assist in loosening the embedded dirt, and it will be seen that the lower end 131 of the rearmost wall 130 is foreshortened. A mounting block 134 is secured to the rear wall 132 and a striker plate 135 is secured to the mounting block 132 by means of a screw or screws 136 so as to trap the brush means 170 between the rear wall 132 of rearmost wall 130 and the striker plate 135. Operation of the device is the same as previously described, except that the fluid will also pass through the brush means 170 before being drawn into the vacuum chamber 140.

It will be noted that a further adjustment capability is present in this embodiment in that by loosening screw or screws 36, the extent to which brush means 70 project can be altered to accommodate differing pile heights.

Also, in this embodiment, the cleaning head 20 does not comprise a substantially closed chamber. Therefore, in the absence of a rear wall, the side walls 123,123 terminate in inturned ends or shields **123*a*,123*a*** to avoid over spray or splashing of the cleaning fluid on adjacent surfaces or articles.

Figure 8:
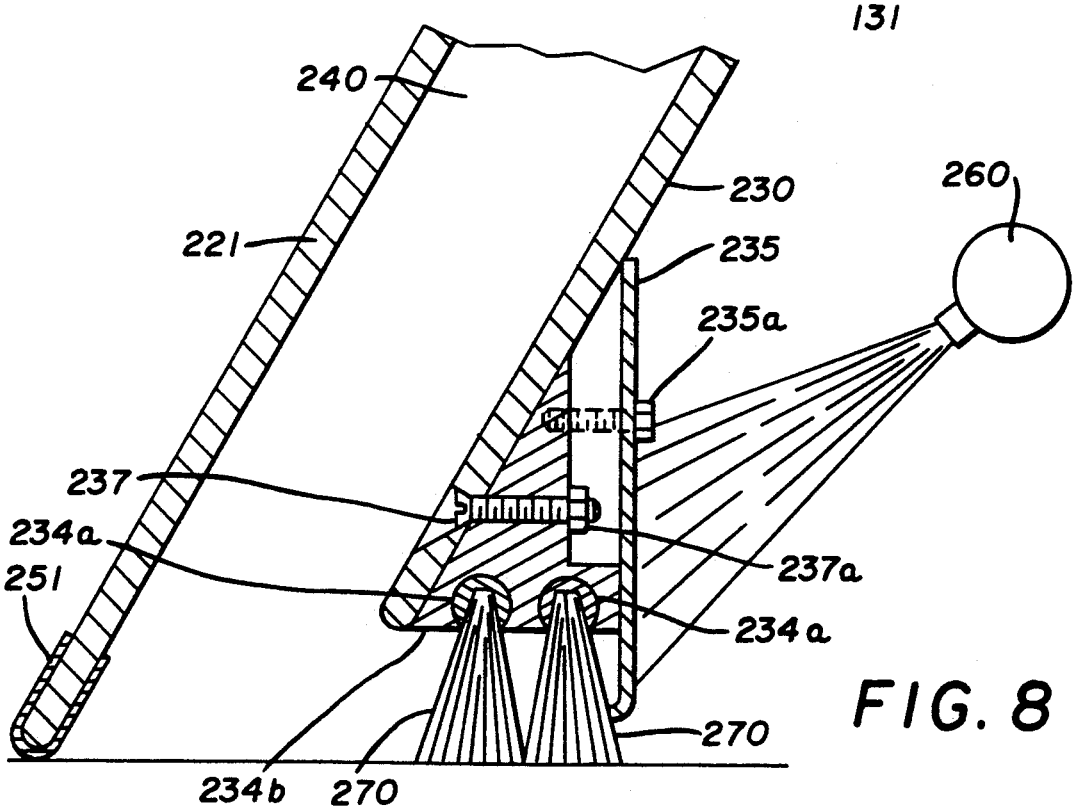
FIG. 8 is a sectional view similar to the view of FIG. 7 illustrating a further modified form of the invention.

In the embodiment illustrated in FIG. 8, it will be noted that numerals in the 200 series have been utilized for comparable elements. This embodiment is similar to that of FIGS. 6 and 7, but employs a plurality of brushes.

Thus, rearmost wall 230, which is again foreshortened, receives a wedge or spacer block 234 which is secured thereto by one or more screws 237 and nuts **237*a*. This spacer block has elongate, transverse bores 234*a*,234*a* opening into its bottom surface 234*b* for receipt of brush means 270,270, as clearly shown in FIG. 8. The striker plate 235, which serves as the impact surface for the cleaning fluid emanating from nozzle means 260, is secured to spacer block 234 by one or more screws 235*a***.

Here again, the fluid first strikes the plate 235, passes through brush means 270,270, through the pile of the carpet and into vacuum chamber 240. Also, striker plate 235 is adjustable.

It will be noted that all embodiments contemplate a similar mode of operation in which the fluid is controlled so as to avoid over deep penetration of the carpet.

While a full and complete description of the invention has been set forth in accordance with the dictates of the Patent Statutes, it should be understood that modifications can be resorted to without departing from the spirit hereof or the scope of the appended claims.

What is claimed is:

1. Apparatus for use with a source of pressurized cleaning fluid and vacuum for cleaning carpet or the like, comprising:

a) a housing having a forward wall and rearmost wall spaced therefrom to form a vacuum chamber therebetween and each having a lower, projecting edge;

b) a plate secured to the face of said rearmost wall facing away from said forward wall and the vacuum chamber and having a lower, projecting edge; and c) a fluid dispensing nozzle carried by said housing behind said rearmost wall for directing the fluid dispensed from the source of pressurized fluid to an area on said plate spaced above said lower projecting edge of said plate.

2. The apparatus of claim 1 wherein the angle of said nozzle with respect to said plate is adjustable whereby the cleaning fluid may be directed at selected areas of said plate.

3. The apparatus of claim 1 wherein said lower projecting edge of said plate is rediused.

4. The apparatus of claim 3 wherein a wear plate is removably received on said lower projecting edge of said forward wall of said housing.

5. The apparatus of claim 1 wherein brush means are removably and adjustably secured to said rearmost wall on the face thereof facing away from said forward wall of said housing.

6. The apparatus of claim 5 wherein said lower projecting edge of said rearmost wall is disposed above the lower edge of said front wall of said housing; and said brush means extend beyond said lower projecting edge of said rearmost wall.

7. The apparatus of claim 1 wherein an elongate handle is secured to said housing.

8. The apparatus of claim 1 wherein said rearmost wall and said forward wall of said housing have upper ends forming a connector for engagement with said handle; and said rearmost wall includes an elongate, substantially straight portion extending from said lower projecting edge to a convex intermediate section and terminating in a final substantially straight portion.

9. Apparatus for use with a source of pressurized cleaning fluid and vacuum for cleaning carpet and the like, comprising:

a) a housing having a forward wall and a rearmost wall spaced therefrom to form a vacuum chamber therebetween;

b) said forward wall and said rearmost wall each having a lower projecting edge;

c) a plate secured to the face of said rearmost wall facing away from said forward wall and the vacuum chamber in spaced relationship therewith;

d) brush means disposed between said striker plate and said rearmost wall and projecting beyond said lower projecting edge of said rearmost wall; and e) a fluid dispensing nozzle carried by said housing behind said rearmost wall for directing fluid from the source of pressurized fluid against said plate.

10. The apparatus of claim 9 wherein said brush means are adjustably mounted.

11. The apparatus of claim 9 wherein a spacer block is attached to said rearmost wall; and said striker plate is attached to said spacer block.

12. The apparatus of claim 11 wherein said spacer block is wedge-shaped in cross-section and has a bottom surface; and said brush means are releasably secured to said bottom surface.

13. The apparatus of claim 9 wherein said brush means include (one or more) individual brushes.

14. A method of cleaning carpet or the like, comprising the steps of:

a) directing a flow of cleaning fluid against an area of one face of a first plate disposed in close adjacency with the carpet, said area being spaced above the edge of said plate;

b) providing a vacuum between the side of the plate opposite the face thereof against which the flow of cleaning fluid is directed and a substantially parallel second plate; and c) drawing the cleaning fluid around the edge of the first plate, through the carpet and into the vacuum between the first and second plates as the plates are moved across the carpet.

15. Apparatus for use with a source of pressurized cleaning fluid and vacuum for cleaning carpet or the like, comprising:

a) a housing having a forward wall and rearmost wall spaced therefrom to form a vacuum chamber therebetween and each having a lower, projecting edge;

b) a plate secured to said rearmost wall and having a lower, projecting edge;

c) a fluid dispensing nozzle carried by said housing for directing fluid from the source of pressurized fluid to an area above said lower projecting edge of said plate;

d) brush means removably and adjustably secured to said rearmost wall on the side thereof opposite said forward wall of said housing; and e) said lower projecting edge of said rearmost wall is disposed above the lower edge of said front wall of said housing; and said brush means extend beyond said lower projecting edge of said rearmost wall.

16. Apparatus for use with a source of pressurized cleaning fluid and vacuum for cleaning carpet and the like, comprising:

a) a housing having a forward wall and a rearmost wall spaced therefrom to form a vacuum chamber therebetween;

b) said forward wall and said rearmost wall each having a lower projecting edge;

c) a plate secured to said rearmost wall in spaced relationship therewith;

d) brush means disposed between said plate and said rearmost wall and projecting beyond said lower projecting edge of said rearmost wall;

e) a fluid dispensing nozzle carried by said housing for directing fluid from the source of pressurized fluid against said plate; and f) said brush means being adjustably mounted.

17. The apparatus of claim 16 wherein a spacer block is attached to said rearmost wall; and said plate is attached to said spacer block.

18. The apparatus of claim 17 wherein said spacer block is wedge-shaped in cross-section and has a bottom surface; and said brush means are releasably secured to said bottom surface.

* * * * *

UNITED STATES PATENT AND TRADEMARK OFFICE

CERTIFICATE OF CORRECTION

PATENT NO. : 5,157,805

DATED : October 27, 1992

INVENTOR(S) : Henry J. Pinter

It is certified that error appears in the above-identified patent and that said Letters Patent is hereby corrected as shown below:

In Column 6, line 39, delete "rediused" and substitute therefor ---radiused---.

Signed and Sealed this

Fifth Day of October, 1993

*Attest:*

*Attesting Officer*

Bruce Lehman

BRUCE LEHMAN

*Commissioner of Patents and Trademarks*